US005087014A

United States Patent [19]

Desjardin

[11] Patent Number: 5,087,014

[45] Date of Patent: Feb. 11, 1992

[54] CLIP FOR HOLDING A TOOL ON A CONTAINER IN TWO POSITIONS

[76] Inventor: Warren Desjardin, 34 Bonita Rd., East Quogue, N.Y. 11942

[21] Appl. No.: 557,687

[22] Filed: Jul. 25, 1990

[51] Int. Cl.[5] ..... A46B 17/00

[52] U.S. Cl. ..... 248/692; 248/110; 248/213.2

[58] Field of Search ..... 248/110, 113, 217.3, 248/909, 692, 213.2; 211/65, 66; 222/85 D, 85 R; 215/100 R; 24/3 L, 563, 555; 15/236.01, 236.08, 236.07, 159 R, 143 R, 246

[56] References Cited

U.S. PATENT DOCUMENTS

| | | | |
|---|---|---|---|
| 1,284,697 | 11/1918 | Johnsen | 248/692 |
| 1,653,374 | 12/1927 | Rossi | 248/692 X |
| 2,309,990 | 2/1943 | Savi | 248/692 X |
| 2,402,374 | 6/1946 | Corn et al. | 248/110 |
| 2,723,826 | 11/1955 | Zanelli | 248/692 |
| 2,916,159 | 12/1959 | O'Neil | 248/909 X |
| 3,531,073 | 9/1970 | Cortina | 248/113 |
| 4,377,239 | 3/1983 | Jimae | 211/65 |
| 4,524,938 | 6/1985 | Strahs | 248/110 |
| 4,757,568 | 7/1988 | Jones | 248/110 X |
| 4,993,671 | 2/1991 | Ste Marie | 248/213.2 X |

*Primary Examiner*—David M. Purol
*Assistant Examiner*—Robert A. Olson
*Attorney, Agent, or Firm*—Richard L. Miller

[57] ABSTRACT

A clip for holding a tool on a container in two positions is provided and consists of a curved U-shaped bracket transversely mounted to a handle of the tool. A mechanism, on the bracket, is for installing the bracket on the open rim of the container. In the first position the working head of the tool can be cantilevered over the open rim of the container. In the second position the working head of the tool can be depended down into the container. In both positions the handle of the tool is maintained in a convenient position for the user to readily grasp.

7 Claims, 1 Drawing Sheet

CLIP FOR HOLDING A TOOL ON A CONTAINER IN TWO POSITIONS

BACKGROUND OF THE INVENTION

The instant invention relates generally to clamp brackets and more specifically it relates to a clip for holding a tool on a container in two positions.

Numerous clamp brackets have been provided in the prior art that are adapted to be anchored fixtures used to join, grip support or compress mechanical or structural parts. While these units may be suitable for the particular purpose to which they address, they would not be as suitable for the purpose of the present invention as hereafter described.

SUMMARY OF THE INVENTION

A primary object of the present invention is to provide a clip for holding a tool that will overcome the shortcomings of the prior art devices.

Another object is to provide a clip for holding a tool on a container in two positions that is mounted to the handle of the tool so that the tool can be installed on the open edge of the container.

An additional object is to provide a clip for holding a tool on a container in two positions, whereby in one position the working head of the tool can be cantilevered over the open rim of the container and in the other position the working head of the tool can be depended down into the container.

A further object is to provide a clip for holding a tool on a container in two positions that is simple and easy to use.

A still further object is to provide a clip for holding a tool on a container in two positions that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
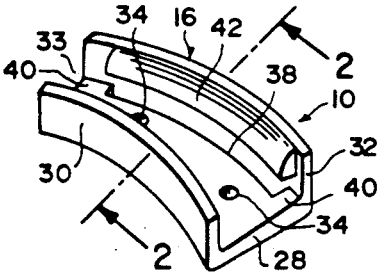
FIG. 1 is a perspective view of the clip of the instant invention per se.
Figure 3:
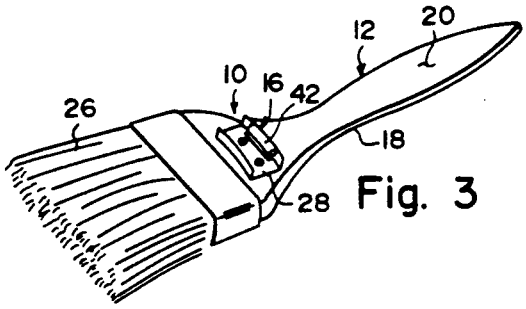
FIG. 3 is a perspective view of a tool, such as a paint brush with the clip mounted onto the handle of the tool.
Figure 2:
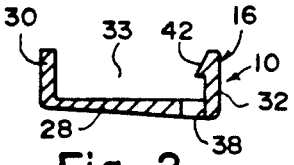
FIG. 2 is a cross sectional view taken along line 2—2 in FIG. 1.
Figure 3A:
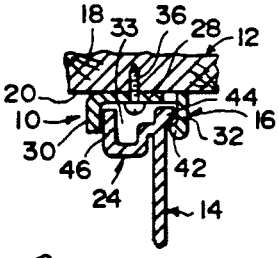
FIG. 3A is a cross sectional view 3 of the clip mounted on the tool as in FIG. 3 installed on the open rim of a container such as a typical paint can.
Figure 3B:
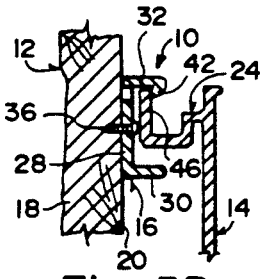
FIG. 3B is a cross sectional view of the clip mounted on the tool as in FIG. 3 installed hanging inside on the open rim of the container.
Figure 4:
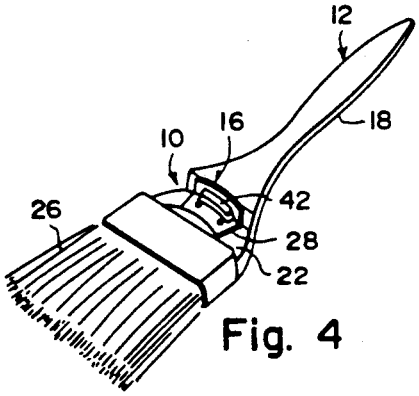
FIGS. 4 and 5 are perspective views of the clip embedded in the handle of the tool.
Figure 5A:
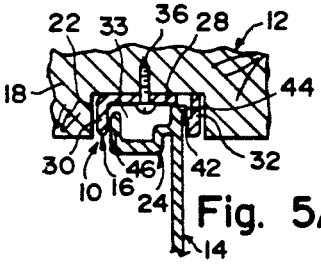
FIG. 5A is a cross sectional view of the clip mounted in the tool as in FIGS. 4 and 5 installed on the open rim of the container.
Figure 5B:
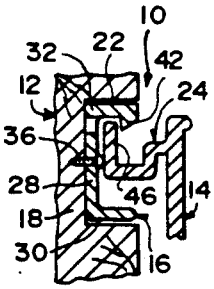
FIG. 5B is a cross sectional view of the clip mounted in the tool as in FIGS. 4 and 5 installed hanging inside on the open rim of the container.
Figure 7:
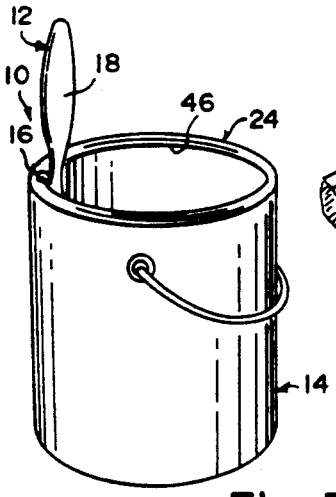
FIG. 7 is a perspective view of the instant invention depending down into the container.
Figure 5:
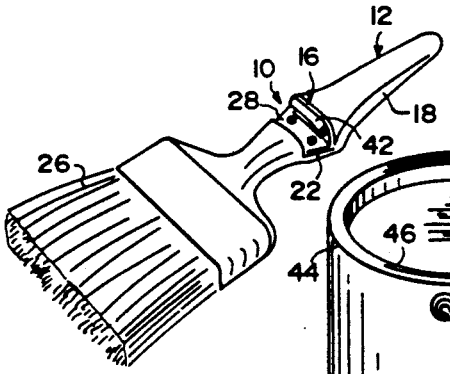
Figure 6:
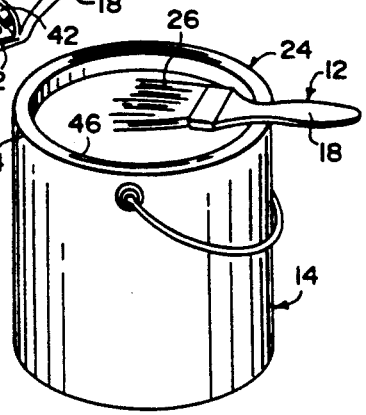
FIG. 6 is a perspective view of the instant invention installed on the open rim of the container with the bristles cantilevered over the paint therein.

Turning now descriptively to the drawings, in which like reference characters denote like elements throughout the several views, the Figures illustrate a clip 10 for holding a tool 12 on a container 14 in two positions. The tool 12 can be a paint brush as shown in the drawings, a putty knife, mixing stick, spoon, ladle, etc. or any other type of spreading tool. The clip 10 consists of a curved U-shaped or channel section bracket 16 transversely mounted to a handle 18 of the tool 12. The bracket 16 can be mounted onto the surface 20 of the handle 18 as best seen in FIGS. 3, 3A and 3B or mounted into a recessed area 22 of the handle 18 as best seen in FIGS. 4, 5, 5A and 5B. The bracket 16 can be installed on the open rim 24 of the container 14 in the first position with the working head 26 being the bristles, of the tool 12 cantilevered over the open rim 24 of the container 14 as shown in FIGS. 3A, 5A and 6. In the second position the working head 26 of the tool 12 is depended down into the container 14 as shown in FIGS. 3B, 5B and 7.

The bracket 16 includes a base portion 28, an inner curved wall portion 30 and an outer curved wall portion 32 integrally formed to each other to create an arcuated opening 33 therebetween. The base portion 28 has a pair of spaced apart mounting holes 34 so that a fastener 36, such as screw can enter each mounting hole 34 and into the handle 18 of the tool 12.

The base portion 28 has an elongated curved slot 38 at the juncture of the outer wall portion 32 thereby forming two flexing portions 40 at the outer wall portion 32. A hook shaped protrusion 42 is on the inner surface of the outer wall portion 32 of the bracket 16 so that in the first position the arcuate opening 33 can fit over the open rim 24 with the extrusion 42 in engagement with an outer lip 44 of the open rim 24 while the inner wall 30 is in engagement with an inner lip 46 of the open rim 24. In the second position the protrusion 42 can hang onto the inner lip 46 of the open rim 24.

The bracket 16 can be fabricated out of any durable metal or plastic material and be manufactured as a separate piece that can be mounted to the handle 18 of tool 12, or in the alternative can be integrally form with the handle. The bracket 16 and the tool 12 can also be attached together and sold as one complete unit. When the tool 12 is installed in the first or second position any materials on the working head 26 of the tool 12 can fall back into the container 14 and be held there in a temporary holding position until it is removed and ready to be used again, while at the same time the tool handle is maintained in a readily convenient for the user to grasp when needed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A clip for securing a tool with a working head and an elongate handle extending therefrom on an open mouthed container in two, different positions, said clip comprising:

a) an integral bracket of channel-section formed by an arcuate base portion and arcuate inner and arcuate outer wall portions upstanding from the base portion defining a longitudinally arcuate channel therebetween, a hook forming protrusion extending from the outer wall portion inwardly of the channel over the base;

b) means for mounting said bracket on the tool with the channel extending transversely thereof and axes of generation of the wall portions extending perpendicularly to the longitudinal axes of the handle so that the wall portions present concave surfaces to the working head, whereby, in a first of the positions, the channel receives the rim of the open mouth container with the inner and outer wall portions engaging between the inner and outer lip portions of the rim thereby securing the tool to the container extending cantilever fashion with the working head substantially horizontal over the open mouth and, in a second position, in which the working head depends substantially vertically into the container by engagement of the hook forming portion with the rim.

2. A clip as recited in claim 1, wherein said mounting means includes:

a) said base portion having at least one mounting hole; and b) at least one fastener, to enter said at least one mounting hole and into the handle of the tool.

3. A clip as recited in claim 1, wherein the hook forming portion engages an inner lip portion of the rim.

4. A clip as recited in claim 1, wherein an elongate slot is formed in the base portion at the junction with the outer wall portions thereby forming two resiliently flexible portions at said outer wall portions over which slot the protrusion extends.

5. A device as recited in claim 4, wherein said mounting means includes:

a) said base portion having at least one mounting hole; and b) at least one fastener, to entering said at least one mounting hole and into the handle of said tool.

6. A device securable on a rim of an open mouthed container in two, different positions comprising a tool with a working head and an elongate handle extending therefrom and a clip comprising:

a) an integral bracket of channel-section formed by an arcuate base portion and arcuate inner and arcuate outer wall portions upstanding from the base portion defining a longitudinally arcuate channel therebetween, a hook forming protrusion extending from the outer wall portion inwardly of the channel over the base;

b) means securing said bracket on the tool with the channel extending transversely thereof and axes of generation of the wall portions extending perpendicularly to the longitudinal axes of the handle so that the wall portions present concave surfaces to the working head, whereby, in a first of the positions, the channel receives the rim of the open mouth container with the inner and outer wall portions engaging between them inner and outer lip portions of the rim thereby securing the tool to the container extending cantilever fashion with the working head substantially horizontal over the open mouth and, in a second position, in which the working head depends substantially vertically into the container by engagement of the hook forming portion with the rim.

7. A device as recited in claim 6, wherein an elongate slot is formed in the base portion at the junction with the outer wall portions thereby forming two resiliently flexible portions at said outer wall portions over which slot the protrusion extends.

* * * * *